US005450635A

United States Patent [19]

Coffey

[11] Patent Number: 5,450,635

[45] Date of Patent: Sep. 19, 1995

[54] DOMED COVER FOR SWIMMING POOLS

[76] Inventor: Ralph D. Coffey, 3001 Elmbrook Rd., Richmond, Va. 23228

[21] Appl. No.: 235,911

[22] Filed: May 2, 1994

[51] Int. Cl.[6] ..... E04H 4/06

[52] U.S. Cl. ..... 4/498

[58] Field of Search ..... 4/498, 499, 503

[56] References Cited

U.S. PATENT DOCUMENTS

| | | | |
|---|---|---|---|
| Re. 30,774 | 10/1981 | Dahlbeck et al. | 4/498 |
| 3,475,768 | 11/1969 | Burton | 4/498 X |
| 3,683,427 | 8/1972 | Burkholz et al. | 4/499 |
| 4,122,562 | 10/1978 | Sorrentino | 4/499 X |
| 4,951,327 | 8/1990 | Del Gorio | 4/503 X |
| 5,144,704 | 9/1992 | Genzel et al. | 4/499 |
| 5,371,907 | 12/1994 | Horvath | 4/498 |

*Primary Examiner*—Charles E. Phillips

[57] ABSTRACT

Disclosed is a new domed cover for use with swimming pools for eliminating incursion of rainwater, leaves, animals, and the like during winter storage thereof whereby reducing the time required to return a swimming pool to service after the storage. The domed cover for swimming pools comprises a framework structure for supporting a pool covering lamina with the center elevated with respect to the edges thereof for shedding water and other objects. The framework structure comprises a horizontal discoid hub member having a plurality of radially oriented elongated support poles extending outwardly and slightly downwardly therefrom. A plurality of equally spaced apart C-shaped clamps is clampedly attached to edges of the swimming pool. Each clamp has a slightly upwardly angled pool-center facing socket formed thereon receiving the outer end of a support pole whereby the hub member is suspended above the surface of the pool water essentially central the pool structure. A covering tarpaulin is disposed over the framework structure whereby unwanted objects and substances are precluded from entering the pool. The tarpaulin has weight means attached around the periphery thereof whereby the tarpaulin is stretched tightly over the framework to prevent dislodgement thereof by wind, animals, and the like.

1 Claim, 4 Drawing Sheets

FIG 1
PRIOR ART
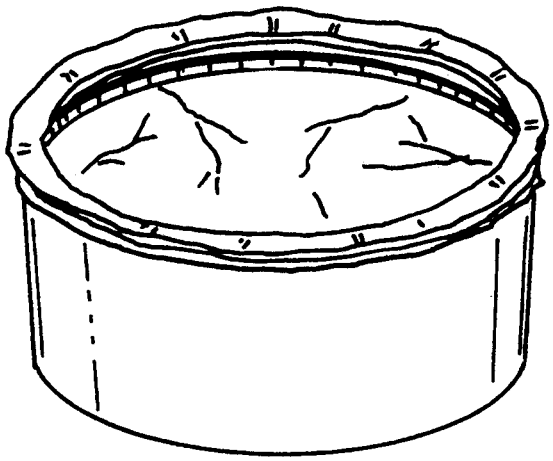
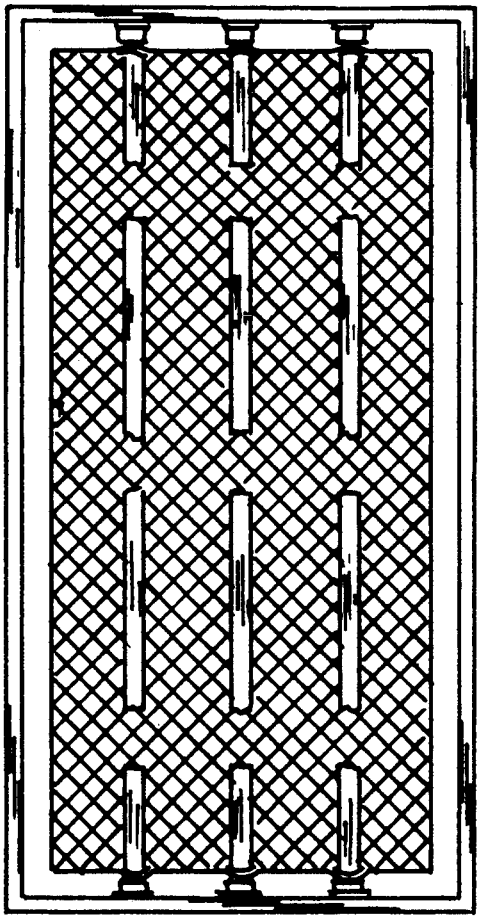
FIG 2
PRIOR ART

DOMED COVER FOR SWIMMING POOLS

BACKGROUND OF THE INVENTION

1. Field of the Invention

The present invention relates to swimming pool covers and more particularly pertains to a domed cover for swimming pools which may be adapted for eliminating incursion of rainwater, leaves, animals, and the like during winter storage thereof whereby reducing the time required to return a swimming pool to service after the storage and additionally for reducing pool water evaporation loss by preventing pool water from flowing onto the top of the cover and further for increasing life expectancy of the cover by preventing immersion thereof during the storage period.

2. Description of the Prior Art

The use of swimming pool covers is known in the prior art. More specifically, swimming pool covers heretofore devised and utilized for the purpose of protecting swimming pools from incursion by foreign objects are known to consist basically of familiar, expected and obvious structural configurations, notwithstanding the myriad of designs encompassed by the crowded prior art which have been developed for the fulfillment of countless objectives and requirements.

The present invention is directed to improving devices for eliminating incursion of rainwater, leaves, animals, and the like during winter storage thereof in a manner which is safe, secure, economical and aesthetically pleasing.

For example, U.S. Pat. No. 3,423,767 to Crook discloses a swimming pool cover including a cover support structure having a center support member consisting of short lengths of pipe coupled by means of four-way fittings. Side support members consisting of bowed or arched lengths of flexible pipe are joined to the center support section by means of the four-way fittings. The ends of the side support members are anchored to the pool coping by means of a three-fingered anchoring device having an upturned center finger inserted in the end of the respective side support pipes and having two downturned finger portions engaging the coping on the edge of the pool. A flexible pool cover is supported by the cover support structure and can be retained in place by means of weights such as sandbags. The swimming pool cover disclosed above consists of a large number of interconnecting rods, anchors, and couplings requiring a correspondingly large amount of time and effort to erect and dismantle the device. The complex nature of the invention also leads to a relatively high cost to manufacture and market.

The prior art also discloses the following patents of interest: U.S. Pat. Nos. 3,854,149 to Mischke, 4,429,425 to Weir et al., 4,667,352 to Leister, and 5,095,557 to Keyes. While these devices fulfill their respective, particular objectives and requirements, the aforementioned patents do not disclose a domed cover for swimming pools for eliminating incursion of rainwater, leaves, animals, and the like during winter storage thereof.

In this respect, the domed cover for swimming pools according to the present invention substantially departs from the conventional concepts and designs of the prior art, and in so doing provides an apparatus primarily developed for the purpose of eliminating incursion of rainwater, leaves, animals, and the like during winter storage thereof whereby reducing the time required to return a swimming pool to service after the storage and additionally for reducing pool water evaporation loss by preventing pool water from flowing onto the top of the cover and further for increasing life expectancy of the cover by preventing immersion thereof during the storage period.

Therefore, it can be appreciated that there exists a continuing need for a new domed cover for swimming pools which can be used for eliminating incursion of rainwater, leaves, animals, and the like during winter storage thereof whereby reducing the time required to return a swimming pool to service after the storage and additionally for reducing pool water evaporation loss by preventing pool water from flowing onto the top of the cover and further for increasing life expectancy of the cover by preventing immersion thereof during the storage period. In this regard, the present invention substantially fulfills this need.

As illustrated by the background art, efforts are continuously being made in an attempt to develop devices for protecting swimming pools from incursion by foreign objects. No prior effort, however, provides the benefits attendant with the present invention. Additionally, the prior patents and commercial techniques do not suggest the present inventive combination of component elements arranged and configured as disclosed and claimed herein.

The present invention achieves its intended purposes, objects, and advantages through a new, useful and unobvious combination of method steps and component elements, with the use of a minimum number of functioning parts, at a reasonable cost to manufacture, and by employing only readily available materials.

SUMMARY OF THE INVENTION

In view of the foregoing disadvantages inherent in the known types of swimming pool covers now present in the prior art, the present invention provides a new swimming pool covers construction wherein the same can be utilized for eliminating incursion of rainwater, leaves, animals, and the like during winter storage thereof. As such, the general purpose of the present invention, which will be described subsequently in greater detail, is to provide a new domed cover for swimming pools apparatus and method which has all the advantages of the prior art swimming pool covers and none of the disadvantages.

The invention is defined by the appended claims with the specific embodiment shown in the attached drawings. For the purpose of summarizing the invention, the invention may be incorporated into a new domed cover for use with swimming pools for eliminating incursion of rainwater, leaves, animals, and the like during winter storage thereof whereby reducing the time required to return a swimming pool to service after the storage. The domed cover for swimming pools comprises a framework structure for supporting a pool covering lamina with the center elevated with respect to the edges thereof for shedding water and other objects therefrom. The framework structure comprises a horizontal discoid hub member having a plurality of radially oriented outwardly opening sockets attached to the bottom thereof. The sockets are evenly spaced apart around the circumference of the hub. A plurality of equally spaced apart C-shaped clamps is clampedly attached to edges of the swimming pool, each clamp having a slightly upwardly angled pool-center facing socket formed thereon. A plurality of elongated support poles, each pole having a slightly downwardly angled first end and a straight second end thereon. The first end of each pole is slipedly removedly engaged with a hub socket such that the poles extend radially outwardly slightly downwardly from the hub member. The second end of each pole is slipedly removedly engaged with a clamp socket whereby the hub member is suspended above the surface of the pool water essentially central the pool structure. A covering tarpaulin is disposed over the framework structure whereby unwanted objects and substances are precluded from entering the pool. The tarpaulin has shape and dimensions slightly larger than the pool so to overlap the edges of the pool when installed on the framework. The tarpaulin also has weight means attached around the periphery thereof whereby the tarpaulin is stretched tightly over the framework to prevent dislodgement thereof by wind, animals, and the like.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In as much as the foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the disclosed specific methods and structures may be readily utilized as a basis for modifying or designing other structures for carrying out the same purposes of the present invention. It should be realized by those skilled in the art that such equivalent methods and structures do not depart from the spirit and scope of the invention as set forth in the appended claims.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

Therefore, it is an object of the present invention to provide an domed cover for swimming pools for eliminating incursion of rainwater, leaves, animals, and the like during winter storage thereof whereby reducing the time required to return a swimming pool to service after the storage.

It is another object of the present invention to provide a new domed cover for swimming pools which may be easily and efficiently manufactured and marketed.

It is a further object of the present invention to provide a new domed cover for swimming pools which is of a durable and reliable construction.

An even further object of the present invention is to provide a new domed cover for swimming pools which is susceptible of a low cost of manufacture with regard to both materials and labor, and which accordingly is then susceptible of low prices of sale to the consuming public, thereby making such domed cover for swimming pools economically available to the buying public.

Still yet another object of the present invention is to provide a new domed cover for swimming pools which provides in the apparatuses and methods of the prior art some of the advantages thereof, while simultaneously overcoming some of the disadvantages normally associated therewith.

Still yet another object of the present invention is to provide a new domed cover for swimming pools that reduces pool water evaporation loss by preventing pool water from flowing onto the top of the cover.

Yet another object of the present invention is to provide a new domed cover for swimming pools that increases life expectancy of the cover by preventing immersion thereof during the storage period.

Even still another object of the present invention is to provide a new domed cover for swimming pools that is adaptable to protect all pools regardless of pool shape or whether the pool is in-ground or above ground.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention. The foregoing has outlined some of the more pertinent objects of this invention. These objects should be construed to be merely illustrative of some of the more prominent features and applications of the present invention. Many other beneficial results can be attained by applying the disclosed invention in a different manner or by modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view illustrative of a prior art pool covering.

FIG. 2 is a top plan view illustrative of another prior art pool covering.

DESCRIPTION OF THE PREFERRED EMBODIMENT

Figure 3:
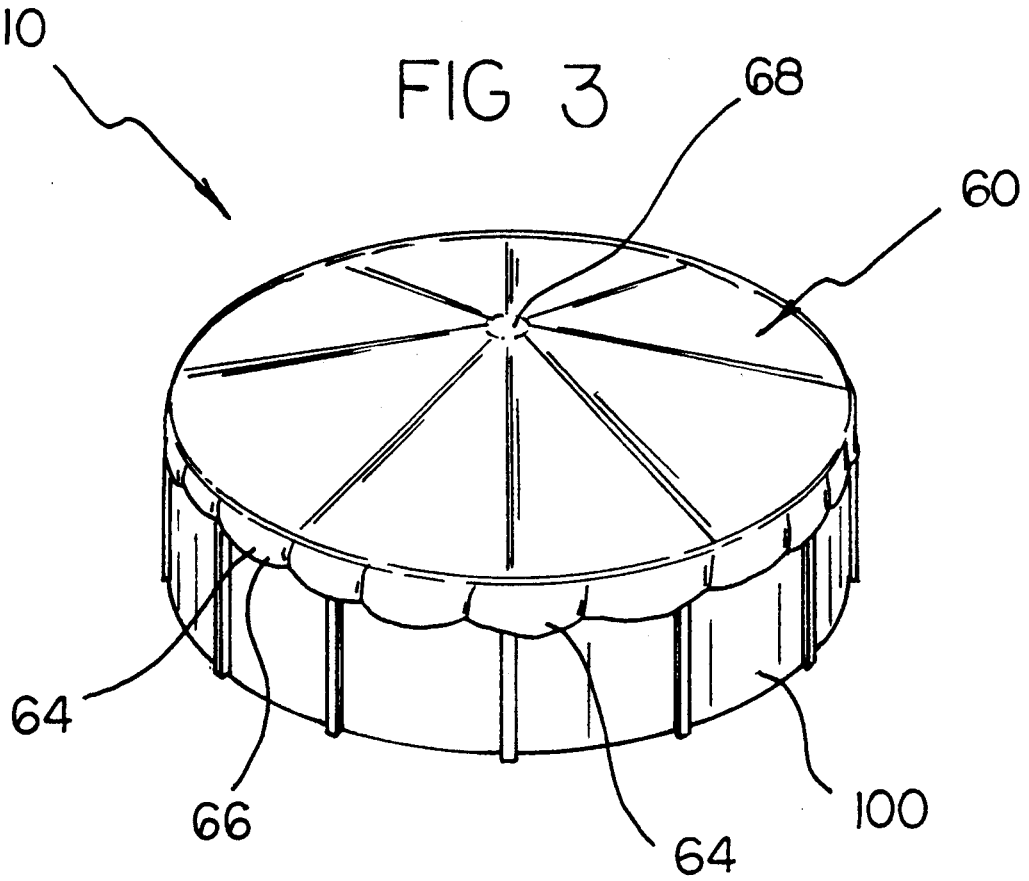
FIG. 3 is a perspective view of the new domed cover for swimming pools showing its manner of use with a typical swimming pool.
Figure 4:
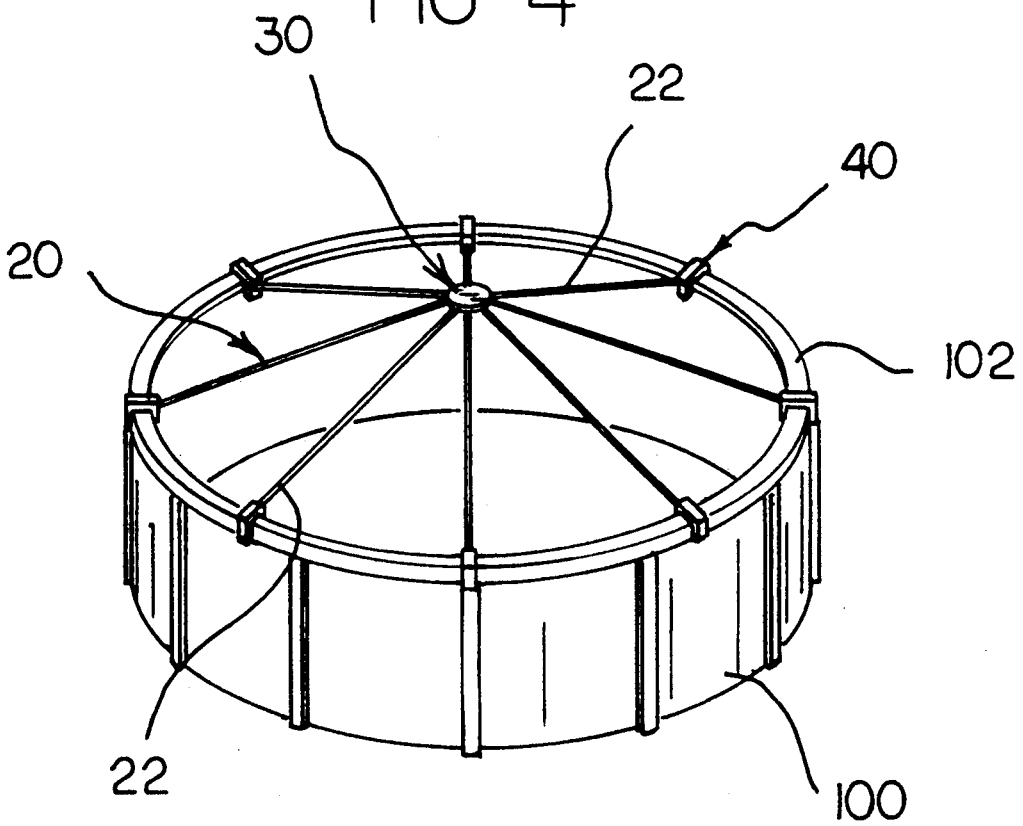
FIG. 4 is a perspective view of the invention of FIG. 3 illustrating the framework without the tarpaulin covering.
Figure 5:
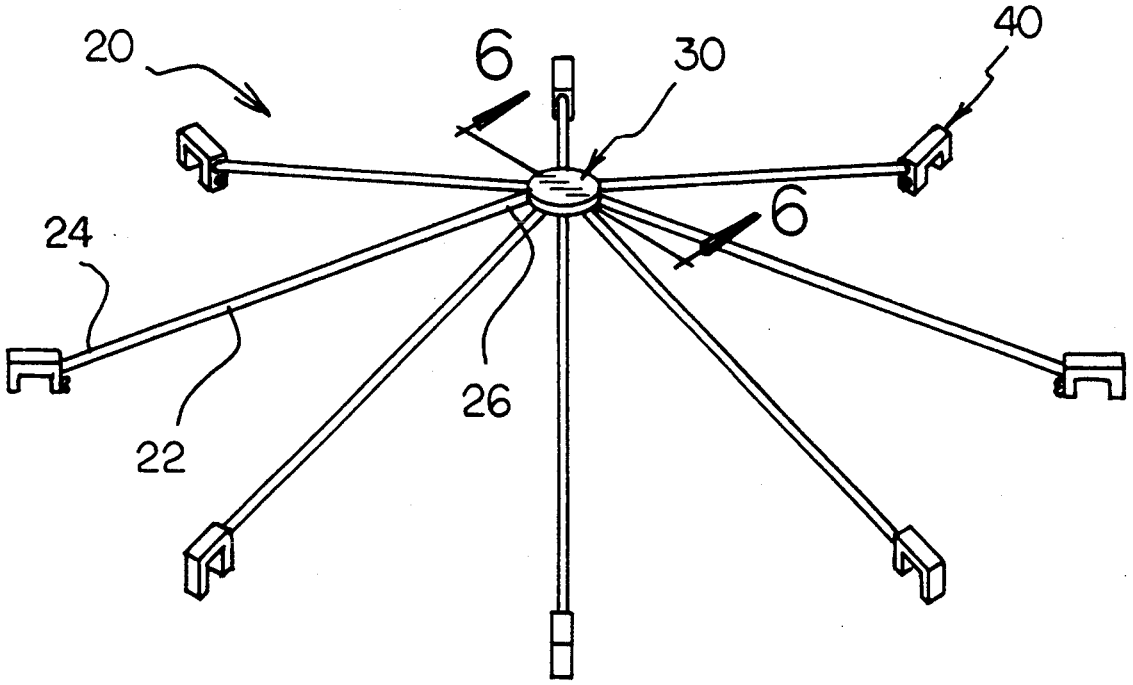
FIG. 5 is a perspective view of the framework structure of the present invention.
Figure 6:
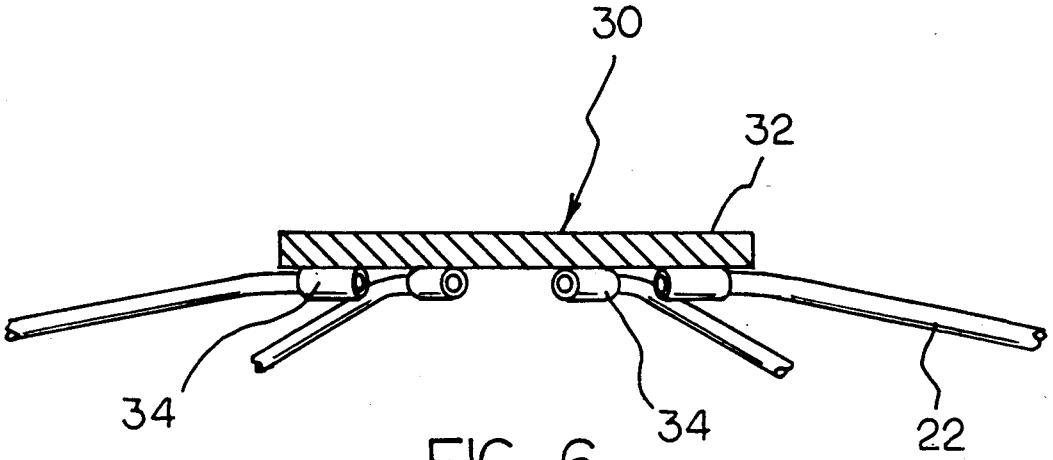
FIG. 6 is a sectional view of the invention of FIG. 5 taken along the line 6—6 and showing the hub connector sockets receiving the support poles.

With reference now to the drawings, and in particular to FIG. 3 thereof, a new domed cover for swimming pools embodying the principles and concepts of the present invention and generally designated by the reference numeral 10 will be described.

From an overview standpoint, the domed cover for swimming pools is adapted for use for eliminating incursion of rainwater, leaves, animals, and the like during winter storage thereof whereby reducing the time required to return a swimming pool to service after the storage and additionally for reducing pool water evaporation loss by preventing pool water from flowing onto the top of the cover and further for increasing life expectancy of the cover by preventing immersion thereof during the storage period. See FIG. 3.

Figure 7:
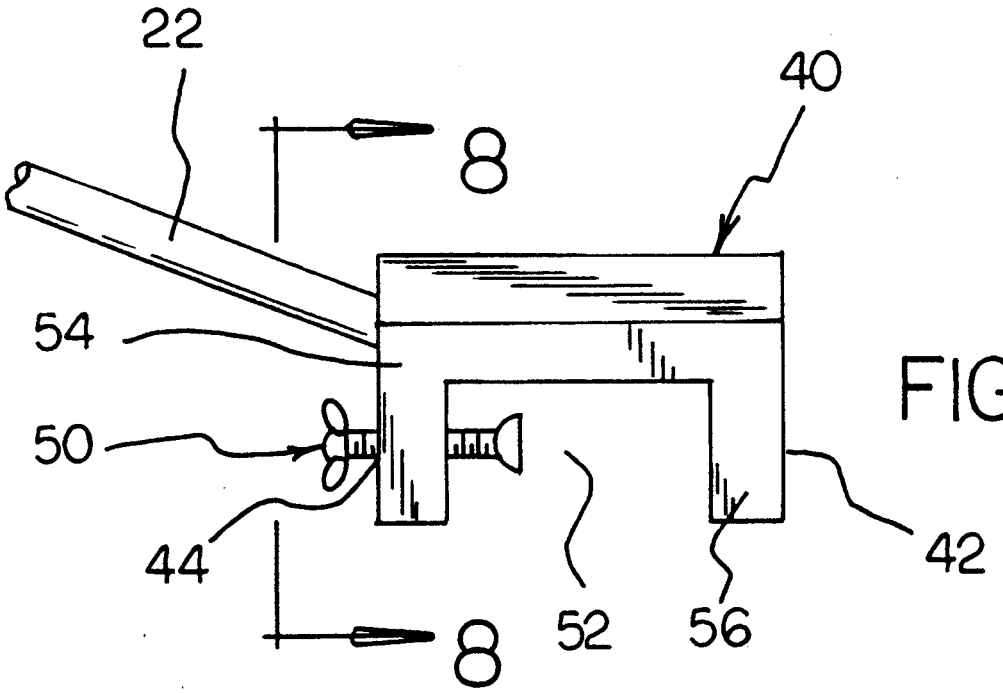
FIG. 7 is a side elevational view of a C-shaped clamp of the present invention showing a support pole engaged therewith.
Figure 8:
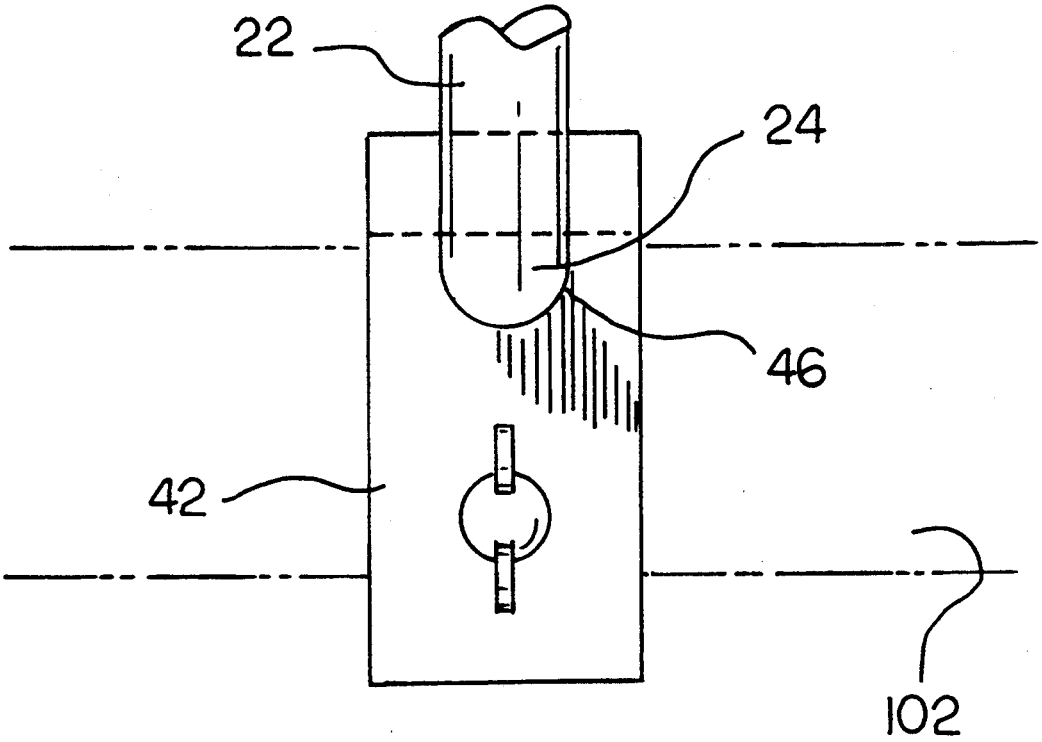
FIG. 8 is a front elevational view of the C-shaped clamp of FIG. 7 illustrating its manner of installation on the edge of a pool.

With reference now to FIGS. 3–8 and more specifically, it will be noted that a new domed cover for use with swimming pools 10 is shown. The domed cover for swimming pools 10 comprises a framework structure 20 for supporting a pool covering lamina with the center 68 elevated with respect to the edges 66 thereof for shedding water and other objects therefrom. The framework structure 20 comprises a horizontal discoid hub member 30 having a plurality of radially oriented outwardly opening sockets 34 attached to the bottom thereof. The sockets 34 are evenly spaced apart around the circumference of the hub 30. A plurality of equally spaced apart clamps 40 is clampedly attached to edges 102 of the swimming pool 100. As best shown in FIGS. 7 and 8, each clamp 40 comprises a C-shaped clamp body 42 having a slightly upwardly angled longitudinal socket 46 formed thereon. The hub 30 is supported only by the sockets 46 at the circumference.

A pair of clamp arms 54 and 56 project downwardly from either end of the clamp body 42 whereby defining a clamping region 52 therebetween wherein the swimming pool edge 102 is retained. A threaded hole 44 extends through the arm 54 of the clamp body 42 proximal the socket 46. A thumbscrew 50 threadedly engages the hole 44 such to extend into the clamping region 52 for securement of the clamp 40 to the pool edge 102. A plurality of elongated support poles 22, each pole 22 having a slightly downwardly angled first end 26 and a straight second end 24 thereon. Each pole has a first portion with a horizontal extent at its upper end and a straight second portion at its lower end connected to the first portion by an obtuse angle portion therebetween. The first end 26 of each pole 22 is slipedly removedly engaged with a hub socket 34 such that the poles 22 extend radially outwardly slightly downwardly from the hub member 30.

The second end 24 of each pole 22 is slipedly removedly engaged with a clamp socket 46 whereby the hub member 30 is suspended above the surface of the pool water essentially central the pool structure 100. A covering tarpaulin 60 is disposed over the framework structure 20 whereby unwanted objects and substances are precluded from entering the pool 100. The tarpaulin 60 has shape and dimensions slightly larger than the pool 100 so to overlap the edges 102 of the pool when installed on the framework 20. The tarpaulin 60 also has weight means 64 attached around the periphery 66 thereof whereby the tarpaulin 60 is stretched tightly over the framework 20 to prevent dislodgement thereof by wind, animals, and the like.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention. In as much as the present disclosure includes that contained in the appended claims as well as that of the foregoing description. Although this invention has been described in its preferred forms with a certain degree of particularity, it is understood that the present disclosure of the preferred form has been made only by way of example and numerous changes in the details of construction and combination and arrangement of parts may be resorted to without departing from the spirit and scope of the invention.

Now that the invention has been described,

What is claimed is:

1. A new domed cover for use with swimming pools for eliminating incursion of rainwater, leaves, animals, and the like during winter storage thereof whereby reducing the time required to return a swimming pool to service after the storage and additionally for reducing pool water evaporation loss by preventing pool water from flowing onto the top of the cover and further for increasing life expectancy of the cover by preventing immersion thereof during the storage period, the domed cover for swimming pools comprising:

a frame work structure for supporting a pool covering lamina with the center of said cover elevated with respect to the edges thereof for shedding water and other objects therefrom, the framework structure comprising: a horizontal discoid hub member having a plurality of radially oriented outwardly opening horizontally disposed sockets attached to the bottom thereof, the sockets being evenly spaced apart around the circumference of the hub with the bottom of the hub, said hub being supported only by the sockets at the circumference of said hub; a plurality of equally spaced apart C-shaped clamps for clampedly attaching to an edge of the swimming pool, each clamp having a pool facing surface with a slightly upwardly angled pool-center facing socket formed therein; a plurality of elongated support poles, each pole having a first portion with a horizontal extent at one end and a straight second portion connected to said first portion by an obtuse angle portion formed therebetween, the horizontal extent of the first portion of each pole being slipedly removedly engaged with a hub socket such that the poles extend radially outwardly then slightly downwardly from the hub member, the second portion of each pole having an end that is slipedly removedly engaged with said clamp socket whereby the hub member is suspended above the surface of the pool water essentially centrally of the pool structure; and a covering tarpaulin disposed over the framework structure whereby unwanted objects and substances are precluded from entering the pool, the tarpaulin having shape and dimensions slightly larger than the pool so to overlap the edges of the pool when installed on the framework, the tarpaulin also having weight means for attachment around the periphery thereof whereby the tarpaulin is stretched tightly over the framework to prevent dislodgement thereof by wind, animals, and the like.

* * * * *